US009389567B2

(12) United States Patent
Kobayashi

(10) Patent No.: US 9,389,567 B2
(45) Date of Patent: Jul. 12, 2016

(54) IMAGE FORMING APPARATUS AND TONER STATE DETERMINATION METHOD THEREOF

(71) Applicant: KYOCERA Document Solutions Inc., Osaka (JP)

(72) Inventor: Kimihiko Kobayashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/809,562

(22) Filed: Jul. 27, 2015

(65) Prior Publication Data

US 2016/0033902 A1 Feb. 4, 2016

(30) Foreign Application Priority Data

Jul. 31, 2014 (JP) ..... 2014-157076

(51) Int. Cl.
*G03G 15/08* (2006.01)
*G03G 15/00* (2006.01)

(52) U.S. Cl.
CPC ..... *G03G 15/55* (2013.01); *G03G 15/087* (2013.01); *G03G 2215/0827* (2013.01)

(58) Field of Classification Search
CPC ..... G03G 15/0889; G03G 15/087; G03G 2215/0827; G03G 15/55
USPC ..... 399/27
See application file for complete search history.

(56) References Cited

FOREIGN PATENT DOCUMENTS

JP 2012237785 A * 12/2012
JP 2013-105037 5/2013

OTHER PUBLICATIONS

Machine translation of JP 2012237785.*

* cited by examiner

*Primary Examiner* — David Bolduc
*Assistant Examiner* — Barnabas Fekete
(74) *Attorney, Agent, or Firm* — Wenderoth, Lind & Ponack, L.L.P.

(57) ABSTRACT

An image forming apparatus includes an accommodating container provided at one end thereof with a toner supply port, a stirring conveying member that conveys toner to the supply port, a rotational driving unit that rotationally drives the stirring conveying member, a current detection unit that detects a driving current, an overload detection section that detects that the stirring conveying member is in an overload state when the driving current is within a range of an excess current, an unevenness determination section that determines whether the toner has been unevenly accumulated at the one end or the other end of the accommodating container, and a cause determination section that determines that a cause of the overload is uneven distribution of the toner when the overload state of the stirring conveying member is detected and being determined that the toner has been unevenly accumulated at the one end or the other end.

7 Claims, 6 Drawing Sheets

IMAGE FORMING APPARATUS AND TONER STATE DETERMINATION METHOD THEREOF

CROSS-REFERENCE TO RELATED APPLICATION

This application is based upon and claims the benefit of priority from Japanese Patent Application No. 2014-157076 filed on Jul. 31, 2014, the entire contents of which are incorporated herein by reference.

BACKGROUND

The technology of the present disclosure relates to an image forming apparatus provided with an accommodating container accommodating toner to be supplied to a developing device and having a stirring conveying member that stirs and conveys the toner, and a toner state determination method of the image forming apparatus.

In an image forming apparatus, at the time of transportation of a toner container that accommodates toner to be supplied to a developing device, when vibration is applied to the toner container or the toner container is left for a long time in a state in which the toner container has been erected with one side facing downward, since the toner is unevenly condensed at one side of the toner container and is condensed, a toner stirring conveying screw receives resistance by the condensed toner, resulting in an increase in load torque of a motor that rotationally drives the screw. If the load torque increases, since excess current flows through the motor, a toner motor driving circuit determines that the screw is in an overload state when it is detected that a driving current becomes large to a level of the excess current.

SUMMARY

An image forming apparatus according to one aspect of the present disclosure includes an accommodating container, a stirring conveying member, a rotational driving unit, a current detection unit, an overload detection section, an unevenness determination section, and a cause determination section.

The accommodating container accommodates toner to be supplied to a developing unit. The accommodating container is provided at one end thereof with a toner supply port to the developing unit.

The stirring conveying member is provided with a rotating shaft extending from the one end toward the other end. The stirring conveying member is rotatably provided in the accommodating container and conveys the toner to the toner supply port while stirring the toner. The rotational driving unit rotationally drives the stirring conveying member. The current detection unit detects a driving current for driving the stirring conveying member by the rotational driving unit. The overload detection section detects that the stirring conveying member is in an overload state when the driving current detected by the current detection unit is within a range of an excess current which is a current exceeding a boundary decided in advance. The unevenness determination section determines whether the toner has been unevenly accumulated at the one end or the other end of the accommodating container. The cause determination section determines that a cause of the overload is uneven accumulation of the toner when the overload state of the stirring conveying member is detected by the overload detection section and the unevenness determination section determines that the toner has been unevenly accumulated at the one end or the other end of the accommodating container.

An image forming apparatus, to which a toner state determination method according to another aspect of the present disclosure is applied, includes a toner sensor, a communication tag, and a reader/writer. The toner sensor is provided in the vicinity of one end of an accommodating container accommodating toner to be supplied to a developing unit and provided at the one end side thereof with a toner supply port to the developing unit. The toner sensor detects an amount of the toner at the one end of the accommodating container. The communication tag is provided at a container outer wall serving as the other end of the accommodating container. The reader/writer is provided at a body side position of the image forming apparatus, which faces the communication tag, and communicates with the communication tag.

The aforementioned toner state determination method includes a step of determining that the toner has been unevenly accumulated at the one end of the accommodating container when the amount of the toner detected by the toner sensor is equal to or more than an amount decided in advance and a high level voltage of the reader/writer is equal to or more than a value decided in advance, and a step of determining that the toner has been unevenly accumulated at the other end of the accommodating container when the amount of the toner detected by the toner sensor is smaller than the amount decided in advance and the high level voltage of a voltage waveform of output of the reader/writer used in communication with the communication tag is lower than the value decided in advance.

BRIEF DESCRIPTION OF THE DRAWINGS

FIG. 4 (B) is a diagram illustrating a received waveform of an RFID reader/writer when toner has been unevenly accumulated at the other end of a toner storage unit.

FIG. 4 (C) is a diagram illustrating an output waveform of a toner sensor when toner has been unevenly distributed at the other end of a toner storage unit.

FIG. 5 (B) is a diagram illustrating a received waveform of an RFID reader/writer when toner has been unevenly distributed at one end of a toner storage unit.

FIG. 5 (C) is a diagram illustrating an output waveform of a toner sensor when toner has been unevenly distributed at one end of a toner storage unit.

DETAILED DESCRIPTION

Hereinafter, an image forming apparatus according to an embodiment will be described with reference to the drawings.

Figure 1:
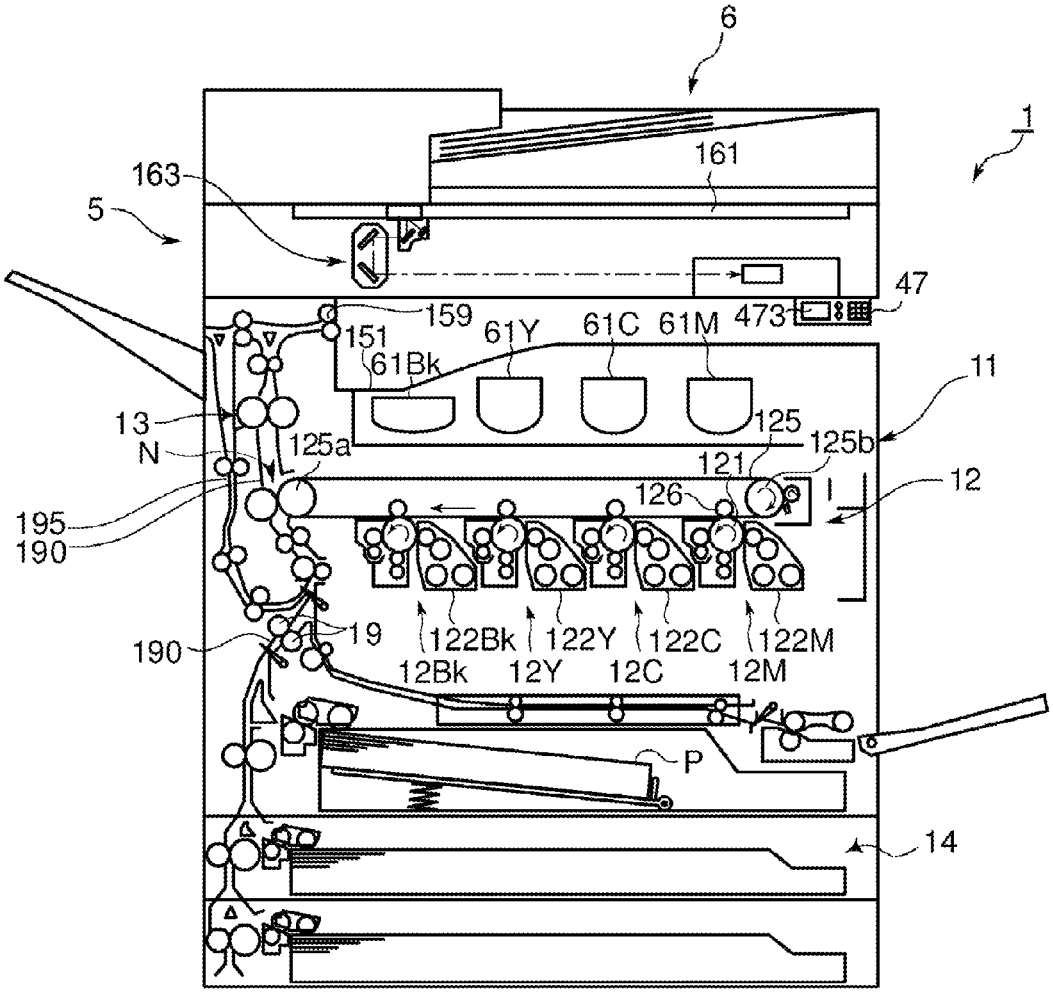
FIG. 1 is a front sectional view illustrating a structure of an image forming apparatus according to an embodiment.

FIG. 1 is a front sectional view illustrating a structure of the image forming apparatus according to the embodiment.

An image forming apparatus 1 according to the embodiment, for example, is a multifunctional peripheral having a plurality of functions such as a copy function, a printer function, a scanner function, and a facsimile function. The image forming apparatus 1 includes an operating unit 47, an image forming unit 12, a fixing unit 13, a paper feeding unit 14, a document feeding unit 6, a document reading unit 5 and the like in an apparatus body 11.

The operating unit 47 receives instructions such as an image formation operation execution instruction and a document reading operation execution instruction for various operations and processes executable by the image forming apparatus 1 from an operator. The operating unit 47 has a display section 473. The display section 473 is an example of a notification section in the scope of the appended claims.

When the image forming apparatus 1 performs a document reading operation, the document reading unit 5 optically reads an image of a document fed by the document feeding unit 6 or a document placed on a document placement glass 161, and generates image data. The image data generated by the document reading unit 5 is preserved in an embedded HDD, a network-connected computer and the like.

When the image forming apparatus 1 performs an image formation operation, the image forming unit 12 forms a toner image on a recording paper P fed from the paper feeding unit as a recording medium on the basis of the image data generated by the aforementioned document reading operation, image data received from the network-connected computer, image data stored in the embedded HDD, and the like. When the image forming apparatus 1 performs color printing, an image forming unit 12M for magenta, an image forming unit 12C for cyan, an image forming unit 12Y for yellow, and an image forming unit 12Bk for black of the image forming unit 12 respectively form toner images on a photosensitive drum 121 through charging, exposure, and development processes on the basis of respective color components constituting the aforementioned image data, and allow the toner images to be transferred onto an intermediate transfer belt 125 by a primary transfer roller 126. The intermediate transfer belt 125 corresponds to an image carrying member.

The toner images of the aforementioned each color transferred onto the intermediate transfer belt 125 are superposed on the intermediate transfer belt 125 by adjusting a transfer timing, and thus become a color toner image. A secondary transfer roller allows the color toner image formed on the surface of the intermediate transfer belt 125 to be transferred to the recording paper P conveyed from the paper feeding unit 14 along a conveyance path 190 at a nip portion N between a driving roller 125*a* and the secondary transfer roller while interposing the intermediate transfer belt 125 between the driving roller 125*a* and the secondary transfer roller. Then, the fixing unit 13 fixes the toner image on the recording paper P to the recording paper P by thermal compression. The recording paper P subjected to the color image formation and the fixing process is discharged to a discharge tray 151.

A developing unit 122M in an image forming unit 12M, a developing unit 122C in an image forming unit 12C, a developing unit 122Y in an image forming unit 12Y, and a developing unit 122Bk in an image forming unit 12Bk respectively perform development processes of magenta M, cyan C, yellow Y, and black Bk. At positions separated from these developing units 122M, 122C, 122Y, and 122Bk, in detail, above the intermediate transfer belt 125, a toner container 61M accommodating magenta toner, a toner container 61C accommodating cyan toner, a toner container 61Y accommodating yellow toner, and a toner container 61Bk accommodating black toner are detachably mounted in a toner container mounting unit (not illustrated) provided in the apparatus body 11 while interposing the intermediate transfer belt 125 between the image forming unit 12M, 12C, 12Y, and 12Bk and the toner containers 61M, 61C, 61Y, and 61Bk. When the toner has been fully used, a container cover (not illustrated) provided in the apparatus body 11 is opened and closed, so that the toner containers 61M, 61C, 61Y, and 61Bk is configured to be able to be exchanged according to necessity.

The toner containers 61M, 61C, 61Y, and 61Bk respectively have a toner supply port 617 (see FIG. 2) protruding from a bottom surface thereof. The toner supply port is connected to an interior of a corresponding developing unit among the developing units 122M, 122C, 122Y, and 122Bk via a pipe (not illustrated) installed in the apparatus body 11 in a nearly vertical posture. In addition, the toner containers 61M, 61C, 61Y, and 61Bk are an example of an accommodating container in the scope of the appended claims.

Figure 2:
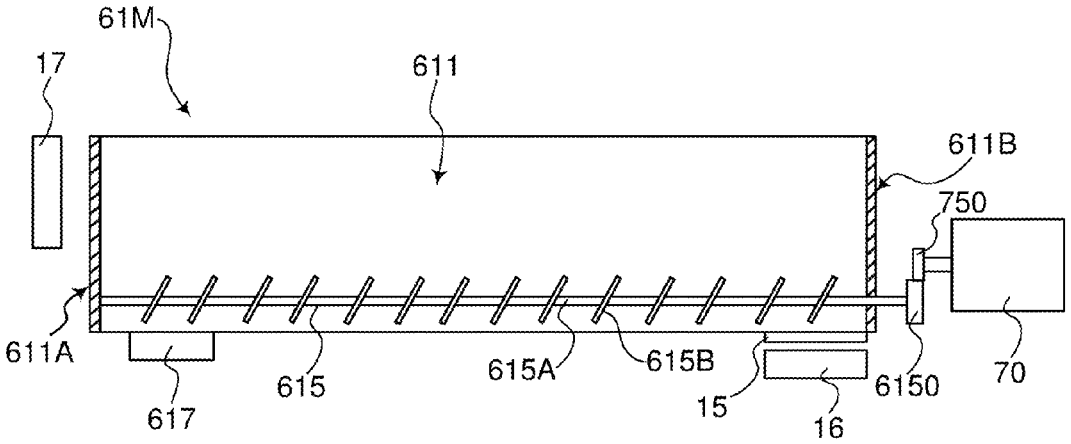
FIG. 2 is a side sectional view illustrating an outline of an internal configuration of a toner container.

FIG. 2 is a side sectional view illustrating an outline of an internal configuration of the toner container 61M. In addition, since the toner containers 61C, 61Y, and 61Bk and the developing units 122C, 122Y, and 122Bk have configurations similar to those of the toner container 61M and the developing unit 122M, a description thereof will be omitted.

The toner container 61M is provided with a toner storage unit 611, a toner stirring conveying screw 615, a motor 700, an RFID (Radio Frequency Identification) tag 15.

The toner storage unit 611 accommodates toner to be supplied to the developing unit 122M, and is provided at one end 611A side thereof with the toner supply port 617 to the developing unit 122M. The toner stirring conveying screw 615 is provided to the one end 611A from the other end 611B of the toner storage unit 611. The toner stirring conveying screw 615 conveys toner to the toner supply port 617 while stirring the toner. In addition, the toner stirring conveying screw 615 is an example of a stirring conveying member in the scope of the appended claims.

The toner stirring conveying screw 615 has a rotating shaft 615A rotatably provided in the toner storage unit 611, and a spiral 615B provided around the rotating shaft 615A in a spiral shape. The rotating shaft 615A extends in a direction toward the one end 611A from the other end 611B. For example, one end of the rotating shaft 615A is mounted at the one end 611A of the toner storage unit 611. At the other end of the rotating shaft 615A, a gear 6150 engaging with a gear 750 provided to the motor 70 is provided.

When the rotating shaft 615A of the toner stirring conveying screw 615 is rotationally driven by receiving rotational driving force from the motor 70, the toner of the toner storage unit 611 is conveyed toward the toner supply port 617 by the spiral 615B rotating together with the rotating shaft 615A. The toner conveyed to the toner supply port 617 falls from the toner supply port 617 to the developing unit 122M by its own weight. In this way, toner is supplied to the developing unit 122M.

At a container outer wall serving as the other end 611B of the toner storage unit 611, the RFID tag 15 is mounted. For example, the RFID tag 15 is a passive type element that obtains operating power from electromagnetic waves emitted from an RFID reader/writer 16 which will be described later. The RFID tag 15 receives the electromagnetic waves from the RFID reader/writer 16 to generate electric power, and drives an embedded circuit by this electric power, thereby performing radio communication with the RFID reader/writer 16 by driving an embedded circuit by the electric power. The RFID tag 15 transmits its own position information to the RFID reader/writer 16 by using an embedded antenna. In addition, the RFID tag 15 is an example of a communication tag in the scope of the appended claims.

When the toner of the toner storage unit 611 is supplied to the developing unit 122M, the amount of toner accommodated at the other end 611B side is reduced. On the other hand, when the toner of the toner storage unit 611 is unevenly accumulated to the other end 611B by transportation and the like, the amount of toner accommodated at the other end 611B side is increased.

Furthermore, at the apparatus body 11 side, the RFID reader/writer 16 is provided. The RFID reader/writer 16 is provided at a position of the apparatus body 11 side of the image forming apparatus 1, which faces the RFID tag 15. In the present embodiment, the RFID reader/writer 16 is provided below the toner container 61M. The RFID reader/writer 16 includes a transmitter, a receiver, an antenna and the like, and transmits electromagnetic waves to the RFID tag 15 or performs radio communication with the RFID tag 15 to receive position information from the RFID tag 15. In addition, the RFID reader/writer is an example of a reader/writer in the scope of the appended claims.

Output of the RFID reader/writer 16, which is used for the communication with the RFID tag 15, is changed in response to the amount of the toner accommodated at the other end 611B side. For example, there is a characteristic that when the amount of the toner accommodated at the other end 611B side is large, a high level voltage indicated by an output voltage waveform decreases, and when the amount of the toner is small, the high level voltage increases. An unevenness determination section 112, which will be described later, monitors the high level voltage of the RFID reader/writer 16.

Furthermore, at the apparatus body 11 side serving as a position facing the one end 611A of the toner storage unit 611, a toner sensor 17 is provided. The toner sensor 17 detects the amount of toner accommodated in the toner container 61M, particularly, the amount of toner existing at the one end 611A of the toner storage unit 611. The toner sensor 17 outputs a voltage value corresponding to the toner amount.

Figure 3:
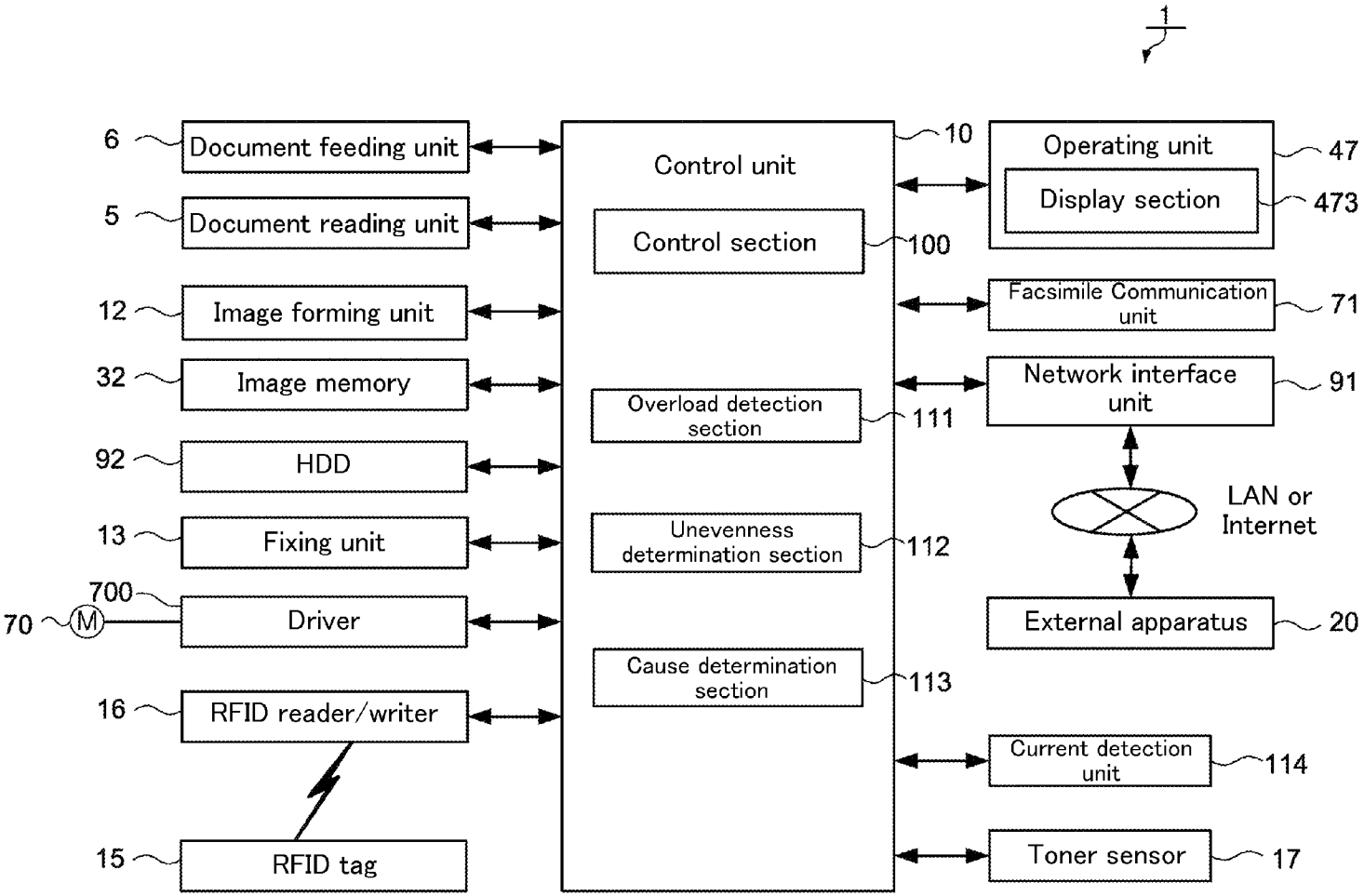
FIG. 3 is a functional block diagram illustrating a main internal configuration of an image forming apparatus.

FIG. 3 is a functional block diagram illustrating a main internal configuration of the image forming apparatus 1. The image forming apparatus 1 includes a control unit 10, the document feeding unit 6, the document reading unit 5, the image forming unit 12, an HDD 92, the fixing unit 13, the motor 70, the operating unit 47, a facsimile communication unit 71, a network interface unit 91, the RFID reader/writer 16, a current detection unit 114, and the toner sensor 17 and the like. The same reference numerals are used to designate the same elements as those described with reference to FIG. 1, and a description thereof will be omitted.

The document reading unit 5 includes a reading mechanism 163 (FIG. 1) having a light irradiating unit, a CCD sensor and the like. The document reading unit 5 irradiates a document by the light irradiating unit and receives reflected light by the CCD sensor, thereby reading an image from the document.

The HDD 92 is a large capacity of nonvolatile storage device that stores image data of the document, which has been read by the document reading unit 5, and the like.

The motor 70 supplies rotational driving force to the toner stirring conveying screw 615. A driver 700 drives the motor 70 under an instruction of a control section 100. In addition, the motor 70 and the driver 700 are an example of a rotational driving unit in the scope of the appended claims.

The current detection unit 114 detects a driving current of the motor 70 by the driver 700 provided to each of the toner containers 61M, 61C, 61Y, and 61Bk, and outputs a detection result to the control section 100.

The control unit 10 includes a CPU (Central Processing Unit), a RAM, a ROM, a dedicated hardware circuit and the like. The control unit 10 has the control section 100, an overload detection section 111, the unevenness determination section 112, and a cause determination section 113.

The control section 100 controls an entire operation of the image forming apparatus 1.

The overload detection section 111 detects overload of the toner stirring conveying screw 615. In detail, when the aforementioned driving current of the motor 70 detected by the current detection unit 114, for example, is within a range of an excess current which is a current exceeding a boundary of a rated current of the motor 70, the overload detection section 111 detects that the toner stirring conveying screw 615 is in an overload state.

The unevenness determination section 112 determines whether toner has been unevenly accumulated at the one end 611A or the other end 611B of the toner storage unit 611 on the basis of respective detection results obtained from the toner sensor 17 and the RFID reader/writer 16.

The cause determination section 113 determines that a cause of the overload is uneven accumulation of toner when the overload state of the toner stirring conveying screw 615 has been detected by the overload detection section 111 and uneven accumulation of toner in one of the one end 611A or the other end 611B of the toner storage unit 611 has been determined by the unevenness determination section 112.

The control section 100 is connected to the document feeding unit 6, the document reading unit 5, the image forming unit 12, the HDD 92, the fixing unit 13, the motor 70, the operating unit 47, the facsimile communication unit 71, the network interface unit 91, the RFID reader/writer 16, the current detection unit 114, and the toner sensor 17 and the like, and performs control of these elements.

The control unit 10 serves as the control section 100 by an operation according to an image processing program. However, the control section 100 can also be configured by a hard circuit regardless of the operation according to the image processing program by the control unit 10. Hereinafter, this is similar in each embodiment unless otherwise specifically noted.

Next, a process for determining a cause of the overload of the toner stirring conveying screw 615 in the image forming apparatus 1 will be described.

Figure 4A:
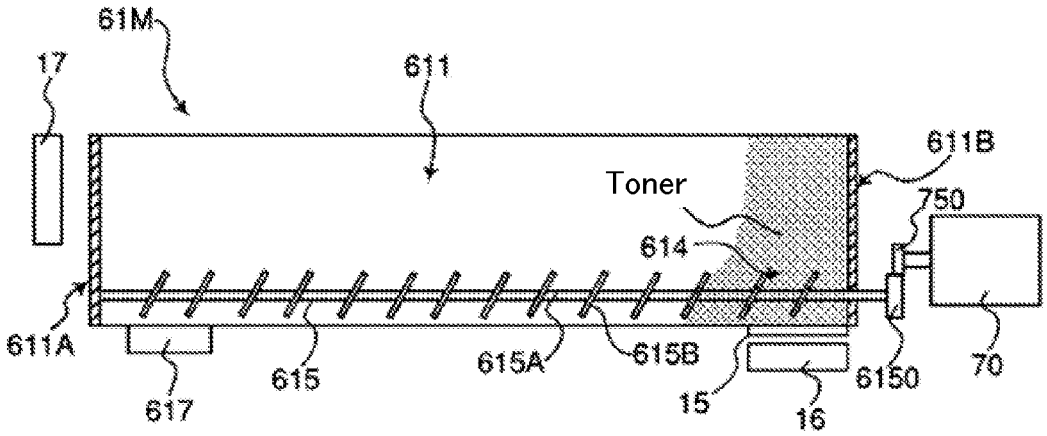
FIG. 4 (A) is a side sectional view illustrating an outline of an internal configuration of a toner container when toner has been unevenly distributed at the other end of a toner storage unit.
Figure 4C:
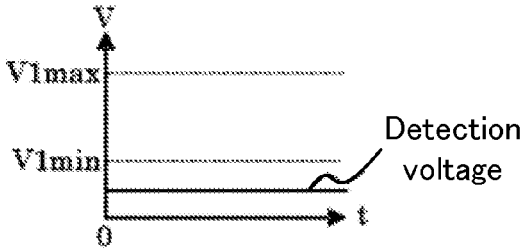
Figure 4B:
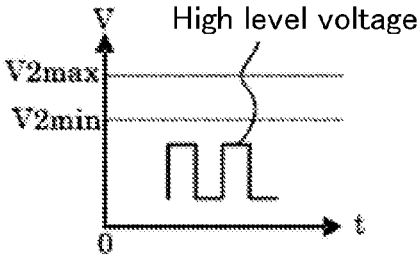

FIG. 4 (A) is a side sectional view illustrating an outline of an internal configuration of the toner container 61M when toner has been unevenly accumulated at the other end 611B of the toner storage unit 611, FIG. 4 (B) is a diagram illustrating a voltage waveform indicating output of the RFID reader/writer 16 when the toner has been unevenly distributed at the other end 611B of the toner storage unit 611, and FIG. 4 (C) is a diagram illustrating an output waveform of the toner sensor 17 when the toner has been unevenly accumulated at the other end 611B of the toner storage unit 611.

Figure 5A:
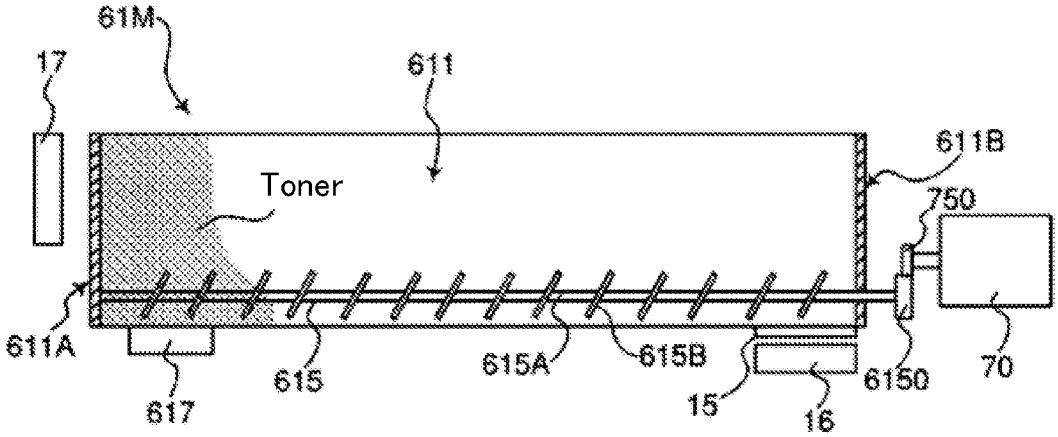
FIG. 5 (A) is a side sectional view illustrating an outline of an internal configuration of a toner container when toner has been unevenly distributed at one end of a toner storage unit.
Figure 5C:
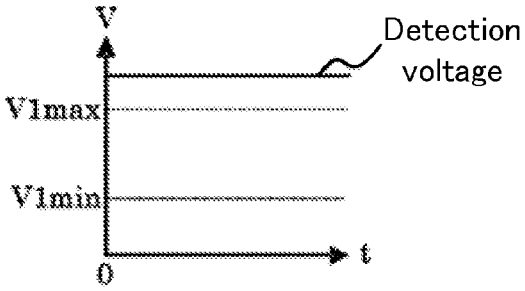
Figure 5B:
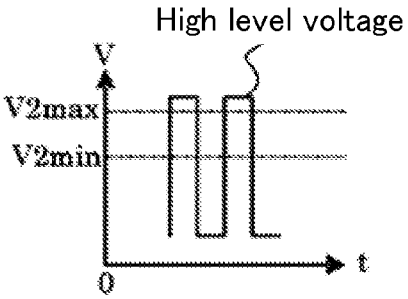

FIG. 5 (A) is a side sectional view illustrating an outline of an internal configuration of the toner container 61M when toner has been unevenly distributed at the one end 611A of the toner storage unit 611, FIG. 5 (B) is a diagram illustrating a voltage waveform indicating output of the RFID reader/writer 16 when the toner has been unevenly distributed at the one end 611A of the toner storage unit 611, and FIG. 5 (C) is a diagram illustrating an output waveform of the toner sensor 17 when the toner has been unevenly distributed at the one end 611A of the toner storage unit 611.

When toner is unevenly distributed at the other end 611B as illustrated in (A) of FIG. 4, since the amount of toner in the vicinity of the RFID reader/writer 16 and the RFID tag 15 becomes large, a high level voltage of a voltage waveform indicating the output of the RFID reader/writer 16 decreases as illustrated in (B) of FIG. 4. Moreover, as illustrated in (C) of FIG. 4, a detection voltage indicating a toner amount detected by the toner sensor 17 and obtained from the sensor becomes low.

In (C) of FIG. 4 and (C) of FIG. 5, V1max is a value decided in advance and is an upper limit value of a voltage when the output of the toner sensor 17 is changed in a normal range, and V1min is a value decided in advance and is a lower limit value of the voltage when the output of the toner sensor 17 is changed in the normal range.

In (B) of FIG. 4 and (B) of FIG. 5, V2max is a value decided in advance and is an upper limit value of a voltage when the output of the RFID reader/writer 16 is changed in a normal range, and V2min is a value decided in advance and is a lower limit value of the voltage when the output of the RFID reader/writer 16 is changed in the normal range.

When the aforementioned detection voltage obtained from the toner sensor 17 is lower than the lower limit value V1min and the aforementioned high level voltage of the RFID reader/writer 16 is lower than the lower limit value V2min, the unevenness determination section 112 determines that the amount of toner existing at the one end 611A is relatively small and toner is unevenly accumulated at the other end 611B.

On the other hand, when toner is unevenly distributed at the one end 611A as illustrated in FIG. 5 (A), since the amount of toner in the vicinity of the RFID reader/writer 16 and the RFID tag 15 becomes small, the high level voltage of the voltage waveform indicating the output of the RFID reader/writer 16 increases as illustrated in FIG. 5 (B). Moreover, as illustrated in FIG. 5 (C), the detection voltage indicating the toner amount detected by the toner sensor 17 and obtained from the sensor becomes high.

When the aforementioned detection voltage obtained from the toner sensor 17 is equal to or more than the upper limit value V1max and the aforementioned high level voltage of the RFID reader/writer 16 is equal to or more than the upper limit value V2max, the unevenness determination section 112 determines that the amount of toner existing at the other end 611B is relatively small and toner is unevenly accumulated at the one end 611A.

Figure 6:
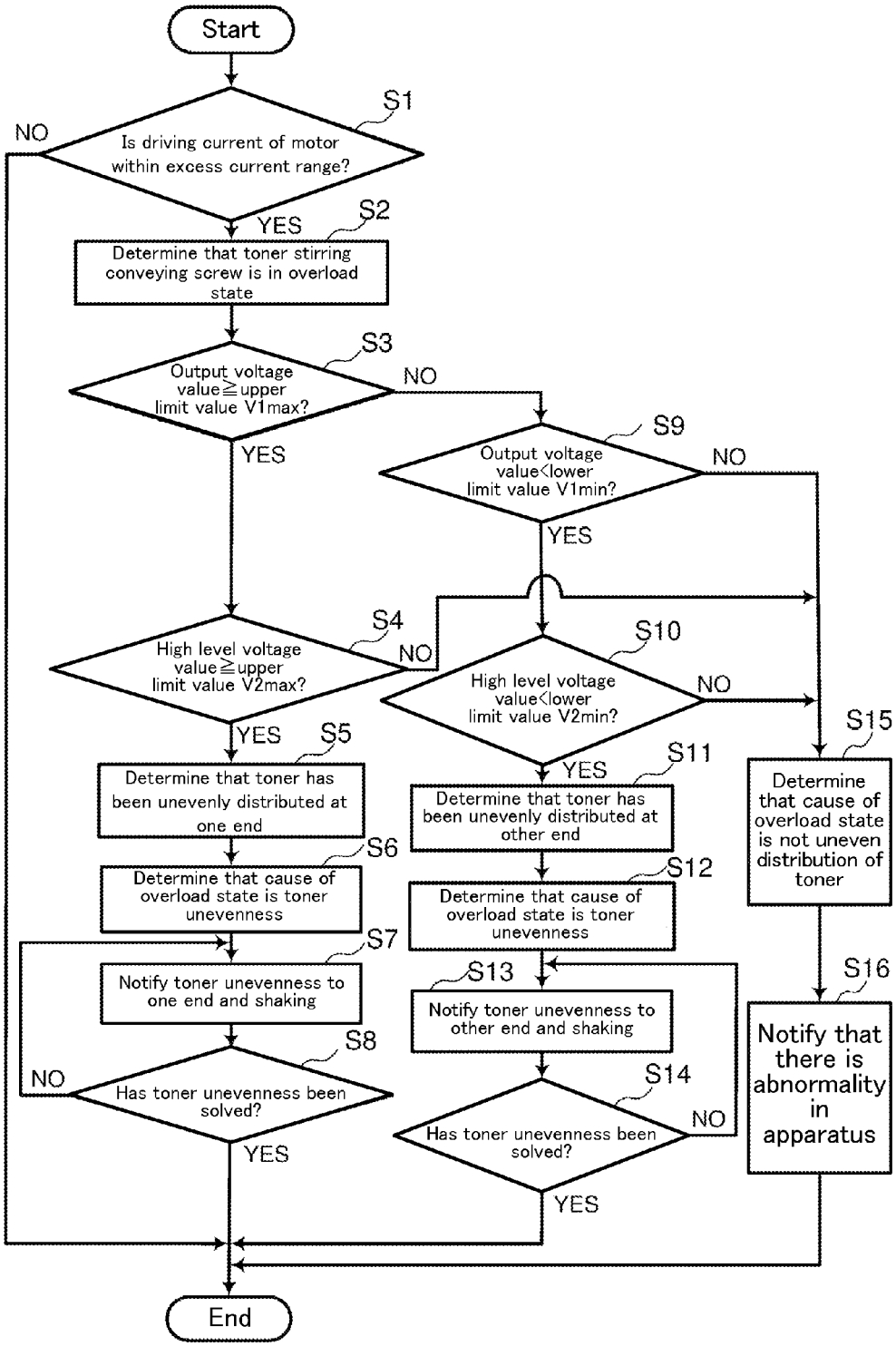
FIG. 6 is a flowchart illustrating a toner unevenness determination operation of an image forming apparatus according to an embodiment.

Next, with reference to FIG. 6, a toner unevenness determination operation of the image forming apparatus according to an embodiment will be described. FIG. 6 is a flowchart illustrating the toner unevenness determination operation of the image forming apparatus according to the embodiment.

The overload detection section 111 determines whether the aforementioned driving current of the motor 70 detected by the current detection unit 114 is within an excess current range decided in advance (S1). When the overload detection section 111 determines that the aforementioned driving current is not within the excess current range decided in advance (NO in S1), the control section 100 receives an instruction for ending the procedure and ends the toner unevenness determination operation of the image forming apparatus 1. When it is determined that the aforementioned driving current is within the excess current range decided in advance (YES in S1), the overload detection section 111 detects that the toner stirring conveying screw 615 is in an overload state (S2).

The unevenness determination section 112 determines whether a voltage value output from the toner sensor 17 as a toner amount detection result is equal to or more than the upper limit value V1max (S3). When the voltage value is smaller than the upper limit value V1max (NO in S3), the unevenness determination section 112 proceeds to S9. When the voltage value is equal to or more than the upper limit value V1max (YES in S3), the unevenness determination section 112 determines whether a high level voltage value of a voltage waveform of a signal used in communication of the RFID reader/writer 16 is equal to or more than the upper limit value V2max (S4).

When the high level voltage value is smaller than the upper limit value V2max (NO in S4), the unevenness determination section 112 proceeds to S15. When the high level voltage value is equal to or more than the upper limit value V2max (YES in S4), the unevenness determination section 112 determines that toner has been unevenly accumulated at the one end 611A of the toner storage unit 611 (S5).

Based on this determination, the cause determination section 113 determines that a cause of the overload state is unevenness of the toner to the one end 611A (S6). That is, based on the determination of YES in S3 and S4 and the determination of S5, the cause determination section 113 determines that the cause of the overload state is the unevenness of the toner to the one end 611A.

The control section 100 controls the display section 473 to display a message for promoting the shaking of a toner container determined to be in the aforementioned overload state among the toner containers 61M, 61C, 61Y, and 61Bk, and a message indicating that toner has been unevenly accumulated at the one end 611A, thereby notifying a user of the situation (S7). In addition, the control section 100 may also control the display section 473 to perform only notification of the shaking of the toner container, or to perform notification including a side at which toner has been unevenly accumulated. When toner has been unevenly distributed at the one end 611A side (the toner sensor 17 side), it is unevenness of the toner supply port 617 side. Accordingly, since it is probable that insufficiently dispersed toner is supplied to a developing unit in the form of a lump even after toner unevenness is solved by shaking the toner container, the control section 100 controls a stirring time to be longer than normal such that toner is sufficiently dispersed.

Then, the unevenness determination section 112 again continues determination regarding whether the conditions that the voltage value output by the toner sensor 17 is equal to or more than the upper limit value V1max and the high level voltage value of the voltage waveform of the signal used in the communication of the RFID reader/writer 16 is equal to or more than the upper limit value V2max are maintained (S8), and allows the notification of S7 to be continued as long as the conditions are satisfied (NO in S8). On the other hand, when the conditions have not been satisfied (YES in S8), that is, when the aforementioned toner unevenness has been solved, the control section 100 ends the toner unevenness determination operation of the image forming apparatus 1.

Furthermore, when the voltage value is smaller than the upper limit value V1max in S3 (NO in S3), the unevenness determination section 112 determines whether the voltage value output from the toner sensor 17 as the toner amount detection result is lower than the lower limit value V1min (S9). When the voltage value is equal to or more than the lower limit value V1min (NO in S9), the procedure proceeds to S15. On the other hand, when the voltage value is lower than the lower limit value V1min (YES in S9), the unevenness determination section 112 determines whether the aforementioned high level voltage of the RFID reader/writer 16 is lower than the lower limit value V2min (S10). When the high level voltage is equal to or more than the lower limit value V2min (NO in S10), the procedure proceeds to S15. When the high level voltage is lower than the lower limit value V2min (YES in S10), the unevenness determination section 112 determines that toner has been unevenly accumulated at the other end 611B of the toner storage unit 611 (S11). Based on the determination, the cause determination section 113 determines that the cause of the overload state is unevenness of the toner to the other end 611B (S12). The control section 100 controls the display section 473 to display a message for promoting the shaking of a toner container determined to be in the aforementioned overload state among the toner containers 61M, 61C, 61Y, and 61Bk, and a message indicating that toner has been unevenly accumulated at the other end 611B, thereby notifying a user of the situation (S13). In addition, the control section 100 may also control the display section 473 to perform only notification of the shaking of the toner container, or to perform notification including a side at which toner has been unevenly accumulated. When toner has been unevenly accumulated at the other end 611B side (the RFID tag 15 and the RFID reader/writer 16 side), it is unevenness of the other end side of the toner supply port 617. Accordingly, it is probable that there is no sufficient toner amount in the toner supply port 617 even after toner unevenness is solved by shaking the toner container. Therefore, control is performed such that a toner amount becomes uniform.

Furthermore, the unevenness determination section 112 again continues determination regarding whether the conditions that the voltage value output by the toner sensor 17 is lower than the lower limit value V1min and the high level voltage value of the voltage waveform of the signal used in the communication of the RFID reader/writer 16 is lower than the lower limit value V2min are maintained (S14), and allows the notification of S13 to be continued as long as the conditions are satisfied (NO in S14). On the other hand, when the conditions have not been satisfied (YES in S14), that is, when the aforementioned toner unevenness has been solved, the control section 100 ends the toner unevenness determination operation of the image forming apparatus 1.

On the other hand, when the voltage value is equal to or more than the lower limit value V1min in S9 (NO in S9) or when the high level voltage is equal to or more than the lower limit value V2min in S10 (NO in S10), the cause determination section 113 determines that the cause of the overload of the toner stirring conveying screw 615 is not the uneven distribution of toner (S15). Then, the control section 100 controls the display section 473 to display the fact that there is abnormality in the apparatus, thereby notifying a user of the fact (S16). Then, the control section 100 receives an instruction for ending the procedure and ends the toner unevenness determination operation of the image forming apparatus 1.

In the present embodiment, the cause determination section 113 determines whether overload of the toner stirring conveying screw 615 has been caused by toner unevenness at the one end 611A or the other end 611B of the toner storage unit 611, or whether the overload has occurred due to causes other than the toner unevenness. When the overload of the toner stirring conveying screw 615 has been caused by the toner unevenness, the control section 100 controls the display section 473 to display a message for promoting the shaking of a corresponding toner container among the toner containers 61M, 61C, 61Y, and 61Bk, and a message indicating that toner has been unevenly distributed at the one end 611A or the other end 611B, thereby notifying a user of the situation. Since the user having received the notification understands the side at which the toner has been unevenly accumulated, the user can shake the toner container to smoothly solve the unevenness.

Furthermore, in the present embodiment, when the cause determination section 113 has determined that the cause of the overload state is not the uneven distribution of toner, the control section 100 controls the display section 473 to display the fact that there is abnormality in the apparatus, thereby notifying a user of the fact. The user having received the notification, for example, inspects toner unevenness by using a manual or the Internet or confirms the toner unevenness through a support center by a phone based on a displayed error code, so that quick countermeasure for restoration becomes possible.

That is, according to the present embodiment, appropriate countermeasure corresponding to the content of the cause of the overload of the toner stirring conveying screw 615 can be guided to a user.

Furthermore, in the aforementioned present embodiment, an example in which the RFID tag 15 and the RFID reader/writer 16 are provided at the other end 611B side and the toner sensor 17 is provided at the one end 611A side (see FIG. 2) has been described; however, the technology of the present disclosure is not limited to the example. The RFID tag 15 and the RFID reader/writer 16 may also be provided at the one end 611A side and the toner sensor 17 may also be provided at the other end 611B side.

In addition, the configurations and processes described in the aforementioned each embodiment with reference to FIG. 1 to FIG. 6 are merely an exemplary embodiment of the technology of the present disclosure, and the configurations and processes of the technology of the present disclosure are not limited thereto.

What is claimed is:

1. An image forming apparatus comprising:

an accommodating container that accommodates toner to be supplied to a developing unit and is provided at one end thereof with a toner supply port to the developing unit;

a stirring conveying member provided with a rotating shaft extending from the one end toward the other end, rotatably provided in the accommodating container, and conveying the toner to the toner supply port while stirring the toner;

a rotational driving unit that rotationally drives the stirring conveying member;

a current detection unit that detects a driving current for driving the stirring conveying member by the rotational driving unit;

an overload detection section that detects that the stirring conveying member is in an overload state when the driving current detected by the current detection unit is within a range of an excess current which is a current exceeding a boundary decided in advance;

an unevenness determination section that determines whether the toner has been unevenly accumulated at the one end or the other end of the accommodating container; and a cause determination section that determines that a cause of the overload state is uneven distribution of the toner when the overload state of the stirring conveying member is detected by the overload detection section and the unevenness determination section determines that the toner has been unevenly accumulated at the one end or the other end of the accommodating container;

a notification section; and a control section that causes the notification section to notify a user of shaking of the accommodating container when the cause determination section determines that the cause of the overload state is the uneven distribution of the toner.

2. The image forming apparatus of claim 1, wherein, when the unevenness determination section determines that the toner has been unevenly accumulated at the one end of the accommodating container, the control section causes the notification section to notify the user of fact that the toner has been unevenly accumulated at the one end and the shaking of the accommodating container.

3. The image forming apparatus of claim 1, wherein, when the unevenness determination section determines that the toner has been unevenly accumulated at the other end of the accommodating container, the control section causes the notification section to notify the user of fact that the toner has been unevenly accumulated at the other end and the shaking of the accommodating container.

4. The image forming apparatus of claim 1, wherein, when the overload state of the stirring conveying member is detected by the overload detection section and the unevenness determination section determines that the toner has not been unevenly accumulated at the one end or the other end of the accommodating container, the cause determination section determines that the cause of the overload state is not the uneven distribution of the toner, and when the cause determination section determines that the cause of the overload state is not the uneven distribution of the toner, the control section causes the notification section to notify the user of fact that there is abnormality in the apparatus.

5. The image forming apparatus of claim 1, further comprising:

a toner sensor provided in vicinity of the one end of the accommodating container to detect an amount of the toner at the one end of the accommodating container;

a communication tag provided at a container outer wall serving as the other end of the accommodating container; and a reader/writer provided at a body side position of the image forming apparatus, which faces the communication tag, and that communicates with the communication tag, wherein, when the amount of the toner detected by the toner sensor is equal to or more than an amount decided in advance and a high level voltage of the reader/writer is equal to or more than a value decided in advance, the unevenness determination section determines that the toner has been unevenly accumulated at the one end of the accommodating container.

6. The image forming apparatus of claim 1, further comprising:

a toner sensor provided in vicinity of the one end of the accommodating container to detect an amount of the toner at the one end of the accommodating container;

a communication tag provided at a container outer wall serving as the other end of the accommodating container; and a reader/writer provided at a body side position of the image forming apparatus, which faces the communication tag, and that communicates with the communication tag, wherein, when the amount of the toner detected by the toner sensor is smaller than an amount decided in advance and a high level voltage of a voltage waveform of output of the reader/writer used in communication with the communication tag is lower than a value decided in advance, the unevenness determination section determines that the toner has been unevenly accumulated at the other end of the accommodating container.

7. A toner state determination method of an image forming apparatus, which includes a toner sensor, which is provided in vicinity of one end of an accommodating container accommodating toner to be supplied to a developing unit and provided at the one end side thereof with a toner supply port to the developing unit and detects an amount of the toner at the one end of the accommodating container, a communication tag provided at a container outer wall serving as the other end of the accommodating container, and a reader/writer provided at a position at a body of the image forming apparatus, which faces the communication tag, and that communicates with the communication tag, the toner state determination method comprising:

a step of determining that the toner has been unevenly accumulated at the one end of the accommodating container when the amount of the toner detected by the toner sensor is equal to or more than an amount decided in advance and a high level voltage of the reader/writer is equal to or more than a value decided in advance; and a step of determining that the toner has been unevenly accumulated at the other end of the accommodating container when the amount of the toner detected by the toner sensor is smaller than the amount decided in advance and the high level voltage of a voltage waveform of output of the reader/writer used in communication with the communication tag is lower than the value decided in advance.

* * * * *